US007635174B2

(12) United States Patent
Bergstedt et al.

(10) Patent No.: US 7,635,174 B2
(45) Date of Patent: Dec. 22, 2009

(54) HEATER CHIP TEST CIRCUIT AND METHODS FOR USING THE SAME

(75) Inventors: Steven W. Bergstedt, Winchester, KY (US); John G. Edelen, Versailles, KY (US); Paul W. Graf, Lexington, KY (US); David G. King, Shelbyville, KY (US); Robert E. Miller, Jr., Louisville, KY (US); George K. Parish, Winchester, KY (US); Kristi M. Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 394 days.

(21) Appl. No.: 11/208,682

(22) Filed: Aug. 22, 2005

(65) Prior Publication Data

US 2007/0040862 A1 Feb. 22, 2007

(51) Int. Cl.
*B41J 29/38* (2006.01)

(52) U.S. Cl. ..... 347/9

(58) Field of Classification Search ..... 347/5, 347/9, 19, 56–62, 74, 26, 48, 50, 12–14, 347/17; 324/763

See application file for complete search history.

(56) References Cited

U.S. PATENT DOCUMENTS 4,500,893 A 2/1985 Sakura
4,742,483 A 5/1988 Morrell
4,769,657 A 9/1988 Takahashi
4,774,526 A 9/1988 Ito
4,907,013 A 3/1990 Hubbard et al.
4,996,487 A 2/1991 McSparran et al.
5,027,135 A 6/1991 Negishi
5,164,747 A 11/1992 Osada et al.
5,182,580 A 1/1993 Ikeda et al.
5,319,389 A 6/1994 Ikeda et al.
5,621,524 A 4/1997 Mitani
5,951,175 A 9/1999 Kawamori
6,120,125 A 9/2000 Kim
6,130,683 A 10/2000 Ju
6,199,969 B1 3/2001 Haflinger et al.
6,371,590 B1 4/2002 Hah
6,616,256 B1 * 9/2003 Cook et al. ..... 347/9
6,771,087 B1 * 8/2004 Oz et al. ..... 324/763
7,014,290 B2 * 3/2006 Chen et al. ..... 347/19
7,036,903 B2 * 5/2006 Choi ..... 347/19
2003/0011658 A1 * 1/2003 Parish ..... 347/58

* cited by examiner

*Primary Examiner*—Hai C Pham
(74) *Attorney, Agent, or Firm*—Dinsmore & Shohl

(57) ABSTRACT

Test circuits on heater chips for testing a heater circuit having a heater element and a first power device. The test circuit can include a second power device, a test device configured to hold the first power device off and the second power device on for a selected heater circuit when the test device receives a signal to activate the test circuit, and a common test output to transmit a signal indicative of a state of the selected heater circuit. Methods for using the same are also provided.

18 Claims, 2 Drawing Sheets

HEATER CHIP TEST CIRCUIT AND METHODS FOR USING THE SAME

TECHNICAL FIELD

The present invention relates to ink jet printheads for use with an ink jet printing apparatus, and more specifically, in one embodiment, to a unique test circuit on a heater chip adapted to detect open heater circuits.

BACKGROUND OF THE INVENTION

Ink jet printing is a conventional technique by which printing is accomplished without requiring contact between the printing apparatus (e.g., a printer, copier or multi-function apparatus) and the substrate, or medium, on which the desired print characters/marks are deposited. For example, a heater on an heater chip associated with a printhead installed in the printing apparatus can be selectively energized for vapor phase droplet formation in ink in an associated ink well. Such vapor phase droplet formation forms a bubble in the ink which causes a drop(s) of the ink to be ejected from a nozzle(s) associated therewith.

Printing a character or mark can be accomplished by energizing the heater (each time a drop is required at a position on the substrate/medium) for a sufficient period of time to generate such a bubble, cause the bubble's growth and cause an ink drop to be ejected from the nozzle(s) by the action of the bubble. One particular configuration of such a heater includes a resistive heating element applied to a substrate of a heater chip.

If a heater fails to heat the ink as desired, a corresponding nozzle(s) is often considered to have failed and/or be "missing." While there are several causes of the failure of a heater to heat ink as desired, one particular cause is the heater element either breaks or fractures and goes to essentially an infinite resistance, thereby preventing the necessary flow of current. In the relevant art, a heater suffering from this type of failure is often generically and interchangeably referred to as either a "blown" heater or an "open" heater (both terms being interchangeably used hereinafter). As can be understood by one of ordinary skill in the art, a blown or open heater can also be used to describe a heater that is experiencing similar non-desired jetting characteristics, such as when the heater has an undesirably high resistance for any number of reasons.

It is desirable to be able to detect heaters that are not properly functioning on a heater chip. This information can be utilized by the printhead and/or printing apparatus/driver to, for example, minimize printing artifacts due to such malfunctioning/non-functioning heaters and/or alert the user of the need to replace the printhead/heater chip. As such, there is a need, for example, for a test circuit adapted to detect an open heater (or an otherwise open circuit containing the heater) on a heater chip. Accordingly, such test circuits on a heater chip and methods for using the same are desired.

SUMMARY OF THE INVENTION

In one embodiment, the present invention relates to a test circuit on a heater chip associated with a printhead. For example, a method for detecting a status (also referred to hereinafter as a state) of a heater circuit on a heater chip is provided. The heater chip comprises a plurality of heater circuits. Each of the plurality of heater circuits comprises a heater and a first power device. In particular, when on, the first power device is configured to allow sufficient current to flow through the heater to cause ejection of ink.

The heater chip further comprises a second power device configured to allow current to flow through the heater, wherein the current is insufficient to cause ejection of ink when the first power device is off and the second power device is on. Moreover, the heater chip further comprises a test output in electrical communication with each of the plurality of heater circuits. The method then involves receiving at the heater chip addressing information for a selected heater. If a signal indicating a test should be performed is received at the heater chip, the first power device corresponding to the selected heater circuit is switched off, the second power device corresponding to the selected heater circuit is on, and a signal is placed on the test output indicative of a state of the selected heater circuit.

Another embodiment of the present invention is a test circuit on a heater chip. The heater chip comprises a plurality of heater circuits. Each of the plurality of heater circuits comprises a heater and a first power device configured such that when the first power device is on, a sufficient current flows through the heater to cause ejection of ink.

Meanwhile, the test circuit comprises a second power device configured such that when the second power device is on and the first power device is off, current flows through a heater corresponding to the second power device in an amount that is insufficient to cause ejection of ink. The test circuit further comprises a test device. The test device is configured to hold the first power device off and the second power device on for a selected heater circuit when the test device receives a signal indicating a test should be performed. In addition, a test output is provided, wherein the test output is configured to transmit a signal indicative of a state of a selected heater circuit. The signal state corresponds to the current flow through the heater of the selected heater circuit when the second power device is on and the first power device is off. The test output is in electrical communication with each of the heater circuits.

The exemplary open circuit test circuit and methods using the same can be advantageous for detecting the status of heater circuits on a heater chip while limiting the current through the respective heaters. These and additional advantages will be apparent in view of the detailed description.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

Figure 1:
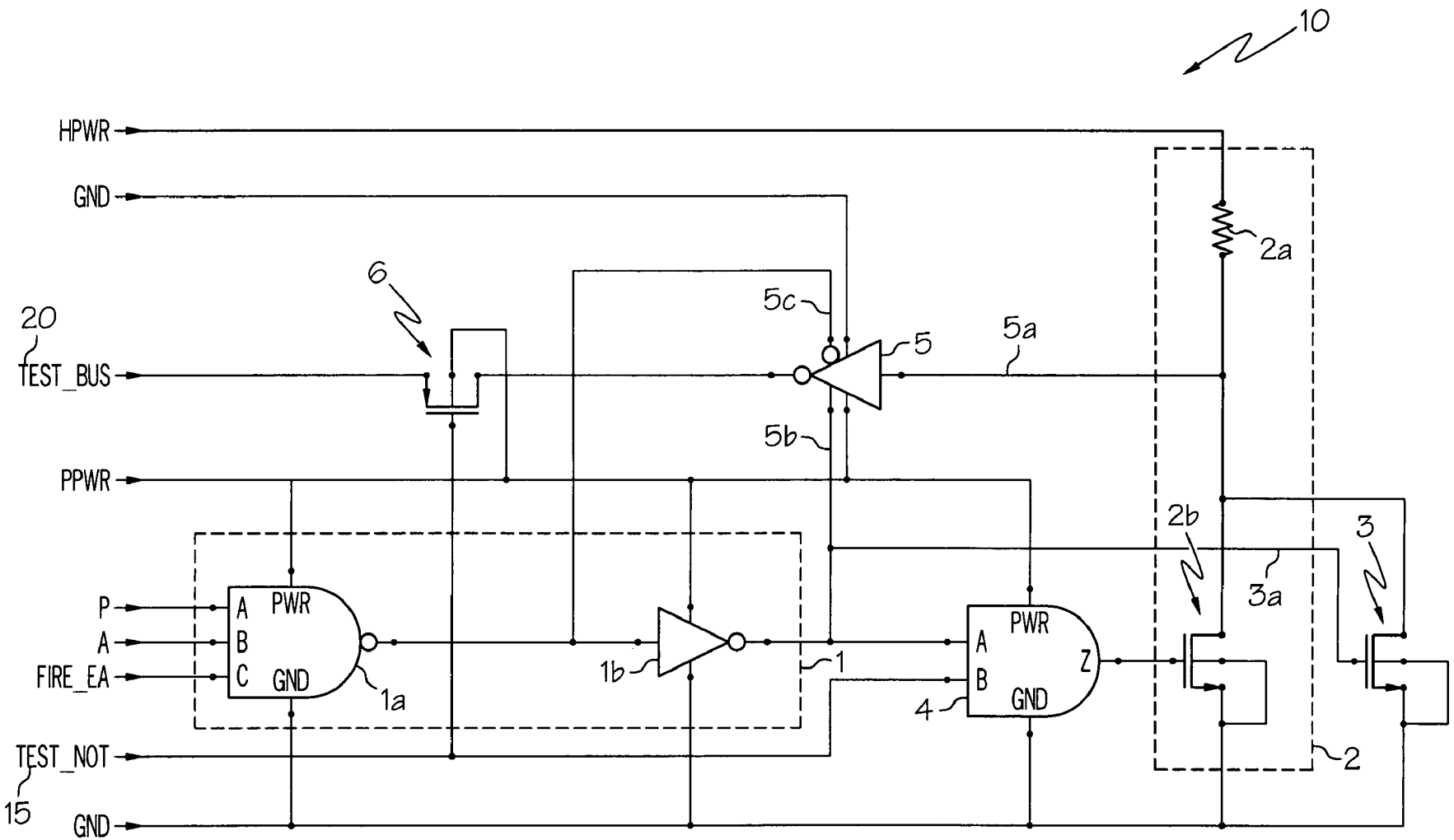
FIG. 1 is a schematic illustration of an exemplary test circuit according to a first embodiment of the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION OF EXEMPLARY EMBODIMENTS OF THE INVENTION

Reference will now be made in detail to various embodiments which are illustrated in the accompanying drawings, wherein like numerals indicate similar elements throughout the views.

One embodiment of the present invention is a method for detecting an open heater circuit, such as a blown heater, on a heater chip. In one such embodiment, for example, a heater circuit can comprise a heater and a first power device configured to selectively activate the heater, such as a first power transistor. For example, a first power transistor can be configured such that, when switched on, sufficient current flows through the heater to cause ejection of ink.

In addition, a test circuit is on the heater chip for each of the heater circuits. Such a test circuit can comprise a second power device (e.g., a second power transistor or segment of the first power transistor), such as one having an on resistance higher than that of the first power device, configured such that when the second power device is switched on and the first power device is switched off, current can still flow through the corresponding heater, but the current is insufficient to cause ejection of ink. In one embodiment, each of these test circuits can be in electrical communication with a common test output bus.

According to such an embodiment, addressing information for a selected heater circuit can be received at the heater chip. Conventionally, addressing information comprises instructions for selecting a heater to activate on the heater chip, such as instructions for selecting a combination of a primitive, an address, and a fire group that is unique to a heater. If a test signal has been received at the heater chip that indicates a test should be performed, logic can switch off the first power device for the selected heater circuit, and logic can switch on the second power device for the selected heater circuit. For example, if the first and second power devices are transistors (or where the second power device is a segment of the first power transistor) connected in parallel with one another, and in series with the selected heater, the aforementioned switching should only allow current to flow through the corresponding second power transistor and the selected heater. Meanwhile, if a test signal is not received at the heater chip that indicates a test should be performed (in some embodiments, a signal might be received indicating that no test should be performed), logic can switch on the first power transistor such that current flows through the first power transistor, and sufficient current flows through the selected heater to cause ejection of ink.

A signal indicative of a state of the heater circuit (e.g., the heater) can be placed on the output test bus, wherein the state can correspond to the current flow through the selected heater (or lack thereof). In one exemplary embodiment, the test output bus comprises a tri-state bus configured to receive a logic high, a logic low, or high impedance. In one embodiment, a counter might also be used in communication with the output test bus. The counter can be adapted to calculate the number (e.g., a quantity) of heaters having a particular state. For example, in one exemplary embodiment, the test output bus is tied to the counter. In one exemplary embodiment, the printer cycles through a given address architecture and, each time an open heater circuit (e.g., a blown heater) is detected, the test bus increments the counter.

In an exemplary embodiment, the output of the counter can be coupled to an output pin on the heater chip. In such an embodiment, once a test is complete, the open heater circuit count can be clocked out to the output pin. In one exemplary embodiment, the counter consists of a serial shift register using the test bus as its clock. The serial shift register may be part of a heater circuit or added as part of the test circuit. In another embodiment, any serial shift register which at the time is not being utilized as part of the addressing of the heater circuit under test could be utilized.

Another exemplary embodiment of the present invention is a method under which each heater circuit (e.g., heater) is placed under test individually, and its state indicated on the test bus at a time unique to that heater circuit. This exemplary method can test each heater circuit individually. For example, in one exemplary embodiment, a printing apparatus addresses a specific heater and the output of the test circuit is placed on the test bus. The test bus is in turn coupled to the output pin of the heater chip.

The printing apparatus can sample the state of the output pin and determine the state of the addressed heater (e.g., is it blown). The printing apparatus and/or printhead can iterate through the entire address architecture, heater by heater, and determine the state of every heater on the chip. Such a method can have the advantage of providing specific information on exactly which heaters are blown.

In one embodiment, this information could be stored in the driver or printhead memory to provide, for example, a "missing nozzle" map (where a nozzle can be identified as "missing" if its corresponding heater(s) is blown, and therefore non-functional). The driver and/or printing apparatus could use the missing nozzle map to, for example, format a print job to adjust for the non-functional heaters/missing nozzles. This can minimize potential degradation to print quality due to attempted use of such non-functional heaters/missing nozzles.

In yet another embodiment, the test method can be applied periodically and the output stored in a computer readable medium. This stored information could be utilized to determine how well a heater chip/printhead performs in actual field use over time. Information pertaining to the number of times a heater is fired can also be collected and stored. In some embodiments, some of this information may already be collected and stored by the printhead or printing apparatus memory, for example.

Another embodiment of the present invention is a test circuit on a heater chip comprising heater circuits. Each of the heater circuits comprises a heater and a first power device (e.g., a transistor) configured such that when the first power device is switched on, sufficient current flows through the heater (and the first power transistor) to cause ejection of ink.

The test circuit can comprise a second power device (e.g., a transistor—or a segment of the first power transistor—such as one having a higher on resistance than the first power transistor). The second power device is configured such that when the second power device is switched on and the first power device is switched off, current flows through the corresponding heater (and second power transistor), but the current flow is insufficient to cause ejection of ink.

In an exemplary embodiment, the test circuit further comprises a test device (hereinafter referred to by example as a test gate), wherein the test gate is configured to hold the first power device off and the second power device on for a selected heater circuit when the test gate receives a signal to activate the test circuit for the selected heater circuit. In addition, the test circuit can include a common test output, such as a bus that is configured to transmit a signal indicative of a state of a selected heater circuit. For example, the state can correspond to the current flow through the heater of the selected heater circuit when the first power device is off.

In an exemplary embodiment, the common test output bus is in electrical communication with each of the heater circuits. The signal on the test output bus may comprise a logic high, logic low or high impedance. For example, depending on the design of the test circuit, the signal may report a logic high to indicate a state where there is no current flow through the heater (or an amount of current that is insufficient to cause the heater to desirably eject ink), indicating a blown heater. In an alternative embodiment, the logic high could indicate a state where there is sufficient current flow through the heater to cause desirable ejection of ink.

In one exemplary embodiment, the test circuit further comprises a counter in electrical communication with the common test output bus. The counter is adapted to calculate the number of heater circuits having a particular state. For example, the counter may determine the number of heater circuits having an open circuit (e.g., a blown heater). Alternatively, the counter may calculate a number of heater circuits not having an open circuit.

In one exemplary embodiment, the counter comprises a serial shift register on the heater chip. As noted above, the heater chip can contain multiple serial shift registers which may be utilized by the test circuit. In one embodiment, the test state signal is outputted to the common test output bus, wherein the common test output bus comprises a tri-state bus. In another embodiment, the test circuit comprises a computer readable medium, wherein the computer readable medium is adapted to store the state of a signal for the heater of a selected heater circuit. This signal state can then be utilized as noted above to, for example, develop a nozzle map related to defective and/or open heater circuits.

In another exemplary embodiment of the present invention, the second power device can be configured to heat (e.g., warm) the substrate of the chip, the heater, and/or the ink (without ejecting ink) if desired. For example, if a second power transistor has a higher on resistance than a first power transistor, the electrical load placed on the heater can be reduced (and as such the strain placed on the heater reduced) in comparison to when the first power transistor is on and the second power transistor is off.

One exemplary embodiment of a test circuit on a heater chip is illustrated in FIG. 1. In this embodiment, the heater chip 10 comprises a heater circuit comprising section 1 and section 2. Section 1 represents a pre-drive circuit, where Section 2 represents a heater circuit. The pre-drive circuit 1 comprises a 3-input NAND gate 1*a* and an inverter 1*b*. The heater circuit 2 comprises a heater 2*a* and a power transistor 2*b*.

In this illustrative embodiment, the test circuit comprises the addition of a 2-input AND gate 4, a tri-state inverter 5, a pmos transistor pass device 6 and a power transistor 3 (having a higher on resistance than power transistor 2*b*), which can comprise a segment of transistor 2*b*. The AND gate 4, inverter 5 and pmos transistor 6 comprise a total of 11 minimum sized logic devices in addition to the heater circuit. In one exemplary embodiment, as mentioned above, the power transistor 3 is a segment of power transistor 2*b*, and does not require additional layout space except for additional gate input 3*a*. The test circuit can be laid out in otherwise existing pre-drive active areas to minimize additional required area on the heater chip.

A "test_not" signal 15 can be utilized to determine if the circuit is in normal or test mode. Meanwhile, a "test_bus" 20 line can be used to communicate the test circuit output, such as to a chip bond pad or additional heater chip circuits for processing.

In one exemplary embodiment, a heater 2*a* can be selected by applying a logic high signal to the inputs of its corresponding NAND gate 1*a*. The resultant output of 1*a* is a logic low which is inverted by inverter 1*b* and passed to input A of the AND gate 4. If no test is desired, the test_not signal 15 is placed in a logical high state, thereby setting the input B of the AND gate 4 to the high state. Given logic highs at inputs A and B, AND gate 4 will place a logical high state on output Z, thereby turning on first power transistor 2*b* to allow sufficient current to flow through heater 2*a* to cause desirable ejection of ink (assuming a proper HPWR). In an exemplary embodiment, the gate 3*a* of the second transistor 3 is also high. As such, in this embodiment, both transistors are on for minimum power transistor series on resistance.

Meanwhile, in the referenced illustrative embodiment, the status of the heater 2*a* can be determined by setting the test_not signal to a logical low state. As above, a heater 2*a* can be selected by placing logic high signals on the inputs to the corresponding NAND gate 1*a* (e.g., via addressing information). In such a scenario, the output of 1*a* would thus be a logical low, which is inverted by inverter 1*b*. With the test_not signal a logical low, the output Z of the AND gate is held at a logical low state, regardless of the input at A. This holds first power transistor 2*b* off and prevents the flow of a current through heater 2*a* that is sufficient enough to cause ejection of ink.

In the illustrative embodiment, the transistor (segment) gate 3*a* is directly connected to the output of the inverter 1*b*. As set forth in the current example, if this output is being held at a logical high, and if heater 2*a* is in proper working order, a small amount of current will flow through the heater 2*a* (in comparison to the amount of current flowing through the heater when power transistor 2*b* is on, given the relatively higher on-resistance of power transistor 3), as most of the voltage from the input (HPWR) should be dropped across power transistor (segment) 3. In this illustrated embodiment, the voltage at node 5*a* will therefore be a logic high. By contrast, if heater 2*a* is not in proper working order (e.g., it is blown), no current will flow through heater 2*a* and node 5*a* is pulled to ground potential (representing a logic low state), or a current will flow in an amount that is insufficient to cause a logic high state on node 5*a* (e.g., causing a voltage at node 5*a* that is below the threshold voltage for a logic high).

The tri-state inverter 5 will attempt to drive the test bus to a logic high or logic low state when enabled. The tri-state inverter 5 is enabled by placing a logic high at input 5*b* and a logic low at input 5*c*. As illustrated in FIG. 1, the necessary logic signals can be utilized from a conventional pre-drive circuit (although use of a conventional pre-drive circuit is not a requirement of the invention, embodiments of the present invention can be integrated into such conventional designs), requiring no additional logic, such that a corresponding tri-state inverter 5 is enabled whenever a particular heater 2*a* is selected via addressing information. As one skilled in the art will appreciate, one could chose to utilize additional logic leads.

When the tri-state inverter 5 is not selected, in an exemplary embodiment, the output looks like a high impedance load to test_bus. It represents no significant load to other devices attempting to drive a line. As noted above, in an exemplary embodiment, all heaters will share the same common test bus.

Pmos pass transistor 6 can be used to prevent multiple tri-state invertors from simultaneously driving the test bus during normal printing. Such could lead to potentially connecting logic power to logic ground through the cmos transistor pairs. The utilization of pmos pass transistor 6 can minimize this from occurring.

Figure 2:
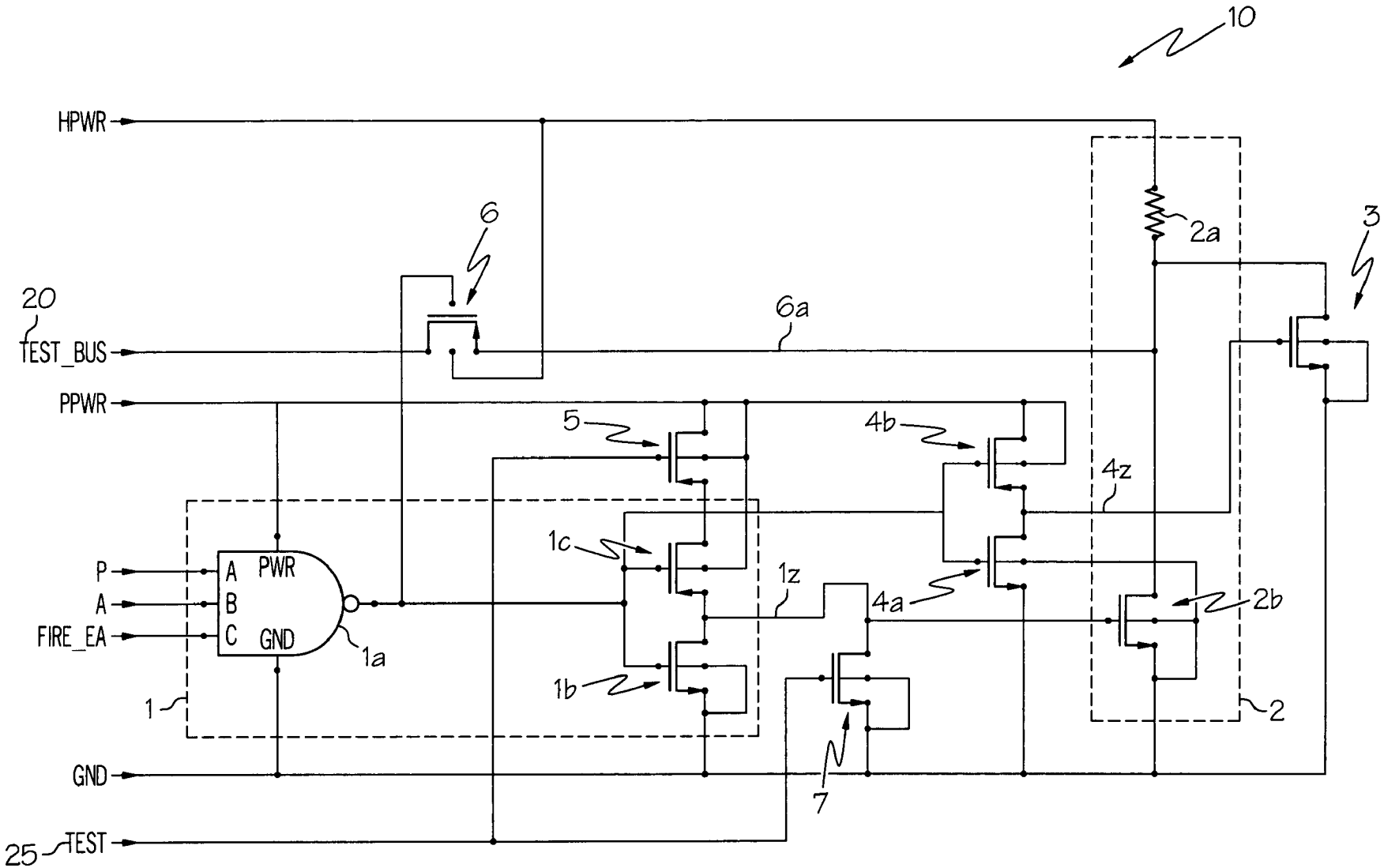
FIG. 2 is a schematic illustration of an exemplary test circuit according to a second embodiment of the present invention.

Another exemplary embodiment of the present invention is illustrated in FIG. 2. As one skilled in the art will appreciate, however, other alternative embodiments can be implemented. FIG. 2 illustrates an exemplary heater chip 10 implementing a open heater circuit test. Sections 1 and 2 represent a pre-drive and heater circuit respectively. The pre-drive circuit comprises a three-input NAND gate 1*a* and inverter (1*b* and 1*c*). The heater circuit has a heater 2*a* and a power transistor 2*b*. In this exemplary reduced device count embodiment implementing an open heater test are a pmos transistor pass device 6, a power transistor (segment) 3, and an inverter (made of devices 4*a* and 4*b*). In addition, the inverter made of devices 1*b* and 1*c* is enabled using device 5 and the power transistor 2*b* is disabled using device 7. The enable and disable transistors, inverters and pmos transistor add a total of 5 minimum sized logic devices to the circuit. The power transistor 3 could be a segment of the power transistor 2*b* and require no additional layout space.

A TEST 25 signal can be used to determine if the circuit is in normal or test mode. TEST_BUS 20 line can be used to communicate the circuit output to a chip bond pad or additional circuits, such as those internal to the heater chip, for processing.

In one exemplary embodiment, a heater 2*a* is selected by applying a logic high signal to the inputs of 1*a*, such as by corresponding addressing information transmitted by the printing apparatus. The output of 1*a* is then a logic low which is inverted by inverter 1*b* and 1*c*. In normal mode, the TEST 25 signal would be placed in a logical low state so that device 5 enables inverter 1*b* and 1*c*, and device 7 is off. In this case, a logic high voltage is placed on the gate of the power transistor 2*b*, which turns the device on and allows a current to flow through the heater 2*a* that is sufficient to cause desirable ejection of ink. It should also be noted that, in this state, the gate of transistor 3 (which could be a segment of transistor 2*b*) is also high. Thus, both transistors are on for the minimum power transistor series on-resistance.

If an indication of the status of the heater element 2*a* is desired, the TEST 25 signal is set to a logical high state. The heater 2*a* is selected as set forth above, wherein logic high signals are placed at the inputs to 1*a* via addressing information. The output of 1*a* is then a logic low.

With the TEST 25 signal set high, transistor 5 is held off so that the output of the inverter 1*b* and 1*c* floats. Transistor 7 is on, so that node 1*z* is pulled to ground potential. This holds the power transistor 2*b* off and prevents the flow of a current through heater 2*a* that is sufficient to cause ejection of ink. However, transistor segment gate 3 can be directly connected to the output of the inverter 4*a* and 4*b*. When a heater 2*a* is in proper working order, a current will flow through the heater (albeit smaller than the current that would flow through the heater if device 2*b* were on), with most of the voltage at the input HPWR being dropped across the power transistor segment 3. The voltage at node 6*a* will therefore be a logic high.

When the heater 2*a* is not in proper working order (e.g., it is blown open) either no current flows through it and node 6*a* is pulled to ground potential (indicating a logic low state), or the current that flows through it will be insufficient to cause a significant enough voltage at node 6*a* to indicate a logic high. This exemplary embodiment can minimize area on a heater chip and the optimization can decrease heater isolation. In this configuration, pmos pass transistor 6 will connect multiple heaters through the TEST_BUS 20 during normal printing. However the impedance of a minimum-size pmos pass transistor 6 is at least 2 orders of magnitude larger than a heater, which should provide sufficient isolation.

The foregoing description of the various embodiments and principles of the invention has been presented for the purpose of illustration and description. It is not intended to be exhaustive or to limit the inventions to the precise forms disclosed. Many alternatives, modifications and variations will be apparent to those skilled in the art. Moreover, although multiple inventive aspects have been presented, such aspects need not be utilized in combination, and various combinations of inventive aspects are possible in light of the various embodiments provided above. Accordingly, the above description is intended to embrace all possible alternatives, modifications, combinations, and variations that have been discussed or suggested herein, as well as all others that fall within the principals, spirit and broad scope of the invention as defined by the claims.

What is claimed:

1. A method for detecting a status of a heater circuit on a heater chip to be used with a print head, wherein the heater chip comprises a plurality of heater circuits, each of the plurality of heater circuits comprising a heater and a first power device wherein the first power device is configured to allow sufficient current to flow through the heater to cause ejection of ink when the first power device is on, each of the plurality of heater circuits further comprising:

a second power device configured to allow current to flow through the heater, wherein the current is insufficient to cause ejection of ink when the first power device is off and the second power device is on; and a test output in electrical communication with each of the other of the plurality of the heater circuits;

the method comprising:

receiving at the heater chip addressing information for a selected heater circuit;

if a signal indicating a test should be performed is received at the heater chip, switching off the first power device corresponding to the selected heater circuit, wherein the second power device corresponding to the selected heater circuit is on, and a signal is placed on the test output indicative of a state of the selected heater circuit and the second power device is configured to warm at least one of the heater, a substrate on which the heater is formed, and the ink.

2. The method of claim 1, further comprising counting the number of heaters having a particular state.

3. The method of claim 1, further comprising storing the state of the selected heater circuit on a computer addressable readable medium associated with the print head.

4. The method of claim 1, further comprising, if a signal indicating a test should be performed is not received at the heater chip, switching on the first power device corresponding to the selected heater circuit.

5. The method of claim 4, wherein the second power device corresponding to the selected heater circuit is not switched off if a signal indicating a test should be performed is not received at the heater chip.

6. The method of claim 1, wherein the signal on the test output is selected from the group consisting of: logic high, logic low and high impedance.

7. A test circuit on a heater chip, wherein the heater chip comprises plurality of heater circuits and wherein each of the plurality of heater circuits comprises a heater and a first power device configured such that when the first power device is on a sufficient current flows through the heater to cause ejection of ink the test circuit being associated with only one of the plurality of heater circuits and comprising:

a second power device configured such that when the second power device is on and the first power device is off, current flows through a heater corresponding to the second power device in an amount that is insufficient to cause ejection of ink;

a test device configured to hold the first power device off and the second power device is on for a selected heater circuit when the test device receives a signal indicating a test should be performed; and a test output in electrical communication with each of the heater circuits and configured to transmit a signal indicative of a state of a selected heater circuit, wherein the signal state corresponds to the current flow through the heater of the selected heater circuit when the second power device is on and the first power device is off, wherein the second power device is configured to warm at least one of the heater, a substrate on which the heater is formed, and the ink.

8. The test circuit of claim 7, further comprising a counter in electrical communication with the test output, wherein the counter is adapted to calculate a number of heater circuits having a particular state.

9. The test circuit of claim 8, wherein the counter comprises a serial shift register on the heater chip.

10. The test circuit of claim 7, wherein the test output comprises a tri-state bus.

11. The test circuit of claim 7, wherein the signal transmitted by the test output is selected from the group consisting of: logic high, logic low and high impedance.

12. The test circuit of claim 7, further comprises a computer readable medium, wherein the computer readable medium is adapted to store the state of the heater of the selected heating circuit.

13. A test circuit on a heater hip, wherein the heater chip comprises a plurality of heater circuits and wherein each of the plurality of heater circuits comprises a heater and a first power transistor configured such that when the first power transistor s switched on a current flows through the heater sufficient to cause ejection of ink, the test circuit associated with only one of the plurality of heater circuits and comprising:

a second power transistor configured such that when the second power transistor is switched on and the first power transistor is switched off current flows through a heater corresponding to the second power transistor in an amount that is insufficient to cause ejection of ink a test gate configured to hold the first power transistor off and the second power transistor on for a selected heater circuit when the test gate receives a signal indicating a test should be perform; and a test output in electrical communication comprising a test with each of the other of the plurality of heater circuits and configured to transmit a signal indicative of a state of a selected heater circuit, wherein the signal state corresponds to the current flow through the heater of the selected heater circuit when the second power transistor is on and the first power transistor is off wherein the second power transistor has a higher on resistance than the first power transistor.

14. The test circuit of claim 13, wherein the second power transistor is a segment of the first power transistor.

15. The test circuit of claim 13, wherein the heater chip is affixed to a print head.

16. The test circuit of claim 15, wherein the print head comprises a reservoir for storing the ink, the heater chip being in fluid communication with the reservoir.

17. The test circuit of claim 13, wherein the signal indicating a test should be performed comprises a logic high.

18. The test circuit of claim 13 wherein the signal indicating a test should be performed comprises a logic low.

* * * * *

UNITED STATES PATENT AND TRADEMARK OFFICE

CERTIFICATE OF CORRECTION

PATENT NO. : 7,635,174 B2
APPLICATION NO. : 11/208682
DATED : December 22, 2009
INVENTOR(S) : Bergstedt et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 873 days.

Signed and Sealed this

Twenty-first Day of December, 2010

David J. Kappos

David J. Kappos
*Director of the United States Patent and Trademark Office*